US007038596B2

(12) United States Patent
Nakajima

(10) Patent No.: US 7,038,596 B2
(45) Date of Patent: May 2, 2006

(54) INFORMATION PROVIDING METHOD FOR VEHICLE AND INFORMATION PROVIDING APPARATUS FOR VEHICLE

(75) Inventor: Toshiharu Nakajima, Fujisawa (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 136 days.

(21) Appl. No.: 10/853,202

(22) Filed: May 26, 2004

(65) Prior Publication Data

US 2004/0239526 A1 Dec. 2, 2004

(30) Foreign Application Priority Data

May 26, 2003 (JP) ..... 2003-147871

(51) Int. Cl.
*G08G 1/09* (2006.01)

(52) U.S. Cl. ..... 340/905; 340/439; 340/995.13; 701/208

(58) Field of Classification Search ..... 340/905, 340/439, 995.12, 995.13, 994; 701/208, 701/211, 213
See application file for complete search history.

(56) References Cited

U.S. PATENT DOCUMENTS 5,193,209 A * 3/1993 Maeda et al. ..... 455/528
5,694,116 A * 12/1997 Kojima ..... 340/576
5,892,463 A * 4/1999 Hikita et al. ..... 340/995.13
6,359,571 B1 * 3/2002 Endo et al. ..... 340/988
6,847,889 B1 * 1/2005 Park et al. ..... 701/209

FOREIGN PATENT DOCUMENTS

JP 2002-318132 10/2002

* cited by examiner

*Primary Examiner*—Anh V. La
(74) *Attorney, Agent, or Firm*—McDermott Will & Emery LLP

(57) ABSTRACT

Vehicle information indicating the conditions of a vehicle is transmitted from an on-vehicle apparatus to an information center at least before audio guidance provided by a and IVR system (interactive voice response system) begins. The IVR system at the information center determines the level of driving load on the driver (the driving load level) based upon the vehicle information having been received and adjusts the manner with which the interactive voice response is provided based upon the determined driving load level, e.g., adjusts the speed with which the automatic audio guidance for the user is output.

8 Claims, 10 Drawing Sheets

FIG.4

| | |
|---|---|
| DATE / TIME POINT | 20020228 22:15:36.35 |
| CURRENT POSITION | LONG E 134.30.32.33 / LAT N 34.55.11.23 |
| VEHICLE CONDITIONS | |
| VEHICLE SPEED SIGNAL 18 | **.*KM |
| BLINKER OPERATION SIGNAL 19 | ON |
| STEERING WHEEL ROTATION ANGLE SIGNAL 20 | . . . |
| REVERSE SIGNAL 21 | OFF |
| LIGHT SIGNAL 22 | ON |
| WIPER OPERATION SIGNAL 23 | ON |

FIG.5A

60

| | DRIVING CONDITION DEDUCING DATA | | | | | |
|---|---|---|---|---|---|---|
| | POSITION(MAPPED AT CENTER BASED UPON ASCERTAINED POSITION) | | | | | |
| | INTERSECTION | ALLEY | CURVE | EXPRESS HIGHWAY | TOOL BOOTH | ENTRANCE/EXIT OF PARKING LOT |
| 62 WEIGHT | 5 | 4 | 3 | 2 | 3 | 4 |
| 1 | ○ | | | | | |
| 2 | ○ | | | | | |
| 3 | ○ | | | | | |
| 4 | ○ | | | | | |
| 5 | ○ | | | | | |
| 6 | ○ | | | | | |
| 7 | ○ | | | | | |
| 8 | ○ | | | | | |
| 9 | ○ | | | | | |
| 10 | ○ | | | | | |
| 11 | ○ | | | | | |
| 12 | ○ | | | | | |
| 13 | ○ | | | | | |
| 14 | ○ | | | | | |
| 15 | ○ | | | | | |
| 16 | ○ | | | | | |
| 17 | ○ | | | | | |
| 18 | ○ | | | | | |
| 19 | ○ | | | | | |
| 20 | ○ | | | | | |
| 21 | ○ | | | | | |
| 22 | ○ | | | | | |
| 23 | ○ | | | | | |
| 24 | ○ | | | | | |
| 25 | | ○ | | | | |
| 26 | | ○ | | | | |
| 27 | | ○ | | | | |
| 28 | | ○ | | | | |
| 29 | | ○ | | | | |
| 30 | | ○ | | | | |
| 31 | | ○ | | | | |
| 32 | | ○ | | | | |
| 33 | | ○ | | | | |
| 34 | | ○ | | | | |
| 35 | | ○ | | | | |
| 36 | | ○ | | | | |
| 37 | | ○ | | | | |
| 38 | | ○ | | | | |
| 39 | | ○ | | | | |
| 40 | | ○ | | | | |
| 41 | | ○ | | | | |
| 42 | | ○ | | | | |
| 43 | | ○ | | | | |
| 44 | | ○ | | | | |
| 45 | | ○ | | | | |
| 46 | | ○ | | | | |
| 47 | | ○ | | | | |
| 48 | | ○ | | | | |
| ··· | ··· | ··· | ··· | ··· | ··· | ··· |

○···ON, BLANK···OFF * EITHER ON OR OFF

FIG.5B

| | 61 | | | | | 63 | 64 |
|---|---|---|---|---|---|---|---|
| | SENSING DATA | | | | | TOTAL | DRIVING LOAD LEVEL |
| | BLINKER SIGNAL | STEERING ANGLE | WIPER SIGNAL | LIGHT SIGNAL | REVERSE SIGNAL | | |
| 62 ► WEIGHT | 4 | 4 | 2 | 1 | 5 | | |
| 1 | | | | | | 5 | LOAD LEVEL 2 |
| 2 | ○ | | | | | 9 | LOAD LEVEL 3 |
| 3 | * | ○ | | | | 9 | LOAD LEVEL 3 |
| 4 | ○ | | ○ | | | 11 | LOAD LEVEL 3 |
| 5 | ○ | | | ○ | | 10 | LOAD LEVEL 3 |
| 6 | ○ | | | | ○ | 14 | LOAD LEVEL 4 |
| 7 | * | ○ | ○ | | | 11 | LOAD LEVEL 3 |
| 8 | * | ○ | | ○ | | 10 | LOAD LEVEL 3 |
| 9 | * | ○ | | | ○ | 14 | LOAD LEVEL 4 |
| 10 | ○ | | ○ | ○ | | 12 | LOAD LEVEL 3 |
| 11 | ○ | | ○ | | ○ | 16 | LOAD LEVEL 4 |
| 12 | ○ | | | ○ | ○ | 15 | LOAD LEVEL 4 |
| 13 | * | ○ | ○ | ○ | | 12 | LOAD LEVEL 3 |
| 14 | * | ○ | ○ | | ○ | 16 | LOAD LEVEL 4 |
| 15 | * | ○ | | ○ | ○ | 15 | LOAD LEVEL 4 |
| 16 | ○ | | ○ | ○ | ○ | 17 | LOAD LEVEL 5 |
| 17 | * | ○ | ○ | ○ | ○ | 17 | LOAD LEVEL 5 |
| 18 | | | ○ | | | 7 | LOAD LEVEL 2 |
| 19 | | | ○ | ○ | | 8 | LOAD LEVEL 2 |
| 20 | | | ○ | | ○ | 12 | LOAD LEVEL 3 |
| 21 | | | ○ | ○ | ○ | 13 | LOAD LEVEL 4 |
| 22 | | | | ○ | | 6 | LOAD LEVEL 2 |
| 23 | | | | ○ | ○ | 11 | LOAD LEVEL 3 |
| 24 | | | | | ○ | 10 | LOAD LEVEL 3 |
| 25 | | | | | | 4 | LOAD LEVEL 1 |
| 26 | ○ | | | | | 8 | LOAD LEVEL 2 |
| 27 | * | ○ | | | | 8 | LOAD LEVEL 2 |
| 28 | ○ | | ○ | | | 10 | LOAD LEVEL 3 |
| 29 | ○ | | | ○ | | 9 | LOAD LEVEL 3 |
| 30 | ○ | | | | ○ | 13 | LOAD LEVEL 4 |
| 31 | * | ○ | ○ | | | 10 | LOAD LEVEL 3 |
| 32 | * | ○ | | ○ | | 9 | LOAD LEVEL 3 |
| 33 | * | ○ | | | ○ | 13 | LOAD LEVEL 4 |
| 34 | ○ | | ○ | ○ | | 11 | LOAD LEVEL 3 |
| 35 | ○ | | ○ | | ○ | 15 | LOAD LEVEL 4 |
| 36 | ○ | | | ○ | ○ | 14 | LOAD LEVEL 4 |
| 37 | * | ○ | ○ | ○ | | 11 | LOAD LEVEL 3 |
| 38 | * | ○ | ○ | | | 15 | LOAD LEVEL 4 |
| 39 | * | ○ | | ○ | ○ | 14 | LOAD LEVEL 4 |
| 40 | ○ | | ○ | ○ | ○ | 16 | LOAD LEVEL 4 |
| 41 | * | ○ | ○ | ○ | ○ | 16 | LOAD LEVEL 4 |
| 42 | | | ○ | | ○ | 6 | LOAD LEVEL 2 |
| 43 | | | ○ | ○ | | 7 | LOAD LEVEL 2 |
| 44 | | | ○ | | ○ | 11 | LOAD LEVEL 3 |
| 45 | | | ○ | ○ | ○ | 12 | LOAD LEVEL 3 |
| 46 | | | | ○ | | 5 | LOAD LEVEL 2 |
| 47 | | | | ○ | ○ | 10 | LOAD LEVEL 3 |
| 48 | | | | | ○ | 9 | LOAD LEVEL 3 |
| ··· | ··· | ··· | ··· | ··· | ··· | | ··· |

○···ON, BLANK···OFF * EITHER ON OR OFF

FIG.5C

65

| 62 WEIGHT | (DEDUCED CONDITIONS) |
|---|---|
| 1 | DRIVING STRAIGHT THROUGH INTERSECTION |
| 2 | BEFORE/AFTER TURNING RIGHT/LEFT AT INTERSECTION |
| 3 | TURNING RIGHT/LEFT AT INTERSECTION |
| 4 | BEFORE/AFTER ENTERING INTERSECTION/IN ROUGH WEATHER |
| 5 | BEFOR/AFTER ENTERING INTERSECTION/AT NIGHT |
| 6 | BEFOR/AFTER ENTERING INTERSECTION/BACKING UP(CONGESTION AHEAD ?) |
| 7 | TURNING RIGHT/LEFT AT INTERSECTION/IN ROUGH WEATHER |
| 8 | TURNING RIGHT/LEFT AT INTERSECTION/AT NIGHT |
| 9 | TURNING RIGHT/LEFT AT INTERSECTION/BACKING UP(ACCIDENT AHEAD ?) |
| 10 | BEFORE/AFTER ENTERING INTERSECTION/IN ROUGH WEATHER/AT NIGHT |
| 11 | BEFORE/AFTER ENTERING INTERSECTION/IN ROUGH WEATHER/BACKING UP |
| 12 | BEFORE/AFTER ENTERING INTERSECTION/AT NIGHT/BACKING UP |
| 13 | TURNING RIGHT/LEFT AT INTERSECTION/IN ROUGH WEATHER/AT NIGHT |
| 14 | TURNING RIGHT/LEFT AT INTERSECTION/IN ROUGH WEATHER/BACKING UP |
| 15 | TURNING RIGHT/LEFT AT INTERSECTION/AT NIGHT/BACKING UP |
| 16 | BEFORE/AFTER ENTERING INTERSECTION/IN ROUGH WETHER/AT NIGHT/BACKING UP |
| 17 | TURNING RIGHT/LEFT AT INTERSECTION/IN ROUGH WETHER/AT NIGHT/BACKING UP |
| 18 | DRIVING STRAIGHT THROUCH INTERSECTION/IN ROUGH WEATHER |
| 19 | DRIVING STRAIGHT THROUCH INTERSECTION/IN ROUGH WEATHER/AT NIGHT |
| 20 | DRIVING STRAIGHT THROUCH INTERSECTION/IN ROUGH WEATHER/BACKING UP |
| 21 | DRIVING STRAIGHT THROUCH INTERSECTION/IN ROUGH WEATHER/AT NIGHT/BACKING UP |
| 22 | DRIVING STRAIGHT THROUCH INTERSECTION/AT NIGHT |
| 23 | DRIVING STRAIGHT THROUCH INTERSECTION/AT NIGHT/BACKING UP |
| 24 | DRIVING STRAIGHT THROUCH INTERSECTION/BACKING UP |
| 25 | DRIVING STRAIGHT THROUCH ALLEY |
| 26 | BEFORE/AFTER TURNING RIGHT/LEFT AT ALLEY |
| 27 | TURNING RIGHT/LEFT AT ALLEY |
| 28 | BEFORE/AFTER ENTERING ALLEY/IN ROUGH WEATHER |
| 29 | BEFORE/AFTER ENTERING ALLEY/AT NIGHT |
| 30 | BEFORE/AFTER ENTERING ALLEY/BACKING UP |
| 31 | TURNING RIGHT/LEFT AT ALLEY/IN ROUGH WEATHER |
| 32 | TURNING RIGHT/LEFT AT ALLEY/AT NIGHT |
| 33 | TURNING RIGHT/LEFT AT ALLEY/BACKING UP |
| 34 | BEFORE/AFTER ENTERING ALLEY/IN ROUGH WEATHER/AT NIGHT |
| 35 | BEFORE/AFTER ENTERING ALLEY/IN ROUGH WEATHER/BACKING UP |
| 36 | BEFORE/AFTER ENTERING ALLEY/AT NIGHT/BACKING UP |
| 37 | TURNING RIGHT/LEFT AT ALLEY/IN ROUGH WEATHER/AT NIGHT |
| 38 | TURNING RIGHT/LEFT AT ALLEY/IN ROUGH WEATHER/BACKING UP |
| 39 | TURNING RIGHT/LEFT AT ALLEY/AT NIGHT/BACKING UP |
| 40 | BEFORE/AFTER ENTERING ALLEY/IN ROUGH WEATHER/AT NIGHT/BACKING UP |
| 41 | TURNING RIGHT/LEFT AT ALLEY/IN ROUGH WEATHER/AT NIGHT/BACKING UP |
| 42 | DRIVING STRAIGHT THROUGH ALLEY/IN ROUGH WEATHER |
| 43 | DRIVING STRAIGHT THROUGH ALLEY/IN ROUGH WEATHER/AT NIGHT |
| 44 | DRIVING STRAIGHT THROUGH ALLEY/IN ROUGH WEATHER/BACKING UP |
| 45 | DRIVING STRAIGHT THROUGH ALLEY/IN ROUGH WEATHER/AT NIGHT/BACKING UP |
| 46 | DRIVING STRAIGHT THROUGH ALLEY/AT NIGHT |
| 47 | DRIVING STRAIGHT THROUGH ALLEY/AT NIGHT/BACKING UP |
| 48 | DRIVING STRAIGHT THROUGH ALLEY/BACKING UP |
| ... | ... |

FIG.6

| DRIVING LOAD LEVEL | RECOGNITION PARAMETERS | | FLOW | | REMARKS |
|---|---|---|---|---|---|
| | a. RECOGNITION WAIT PERIOD | b. RECOGNITION START LEAD TIME | c. FLOW | d. RESPONSE PROMPT FLOW | |
| LOAD LEVEL0 | NORMAL | NORMAL | NORMAL | | EXAMPLE:<br>A: 5 SEC (VARIES FOR INDIVIDUAL STEPS IN THE TALK FLOW (DEPENDING UPON THE STAGE TO WHICH THE DIALOG HAS ADVANCED))<br>B: 0.3 SEC<br>C: FIG. 8 |
| LOAD LEVEL1 | NORMAL | NORMAL | NORMAL | | THE LOAD IS LOW. NORMAL PARAMETER / FLOW SETTINGS. |
| LOAD LEVEL2 | + | + | SPEECH SLIGHTLY SLOWED DOWN | - | BOTH PARAMETERS (PERIODS) ARE INCREASED DUE TO A SLIGHTLY HIGHER LOAD (E.G., A: 7 SEC, B: 0.5 SEC). |
| LOAD LEVEL3 | + | + | SPEECH SLIGHTLY SLOWED DOWN | RESUMPTION AFTER VEHICLE CONDITION RECOVERY IS SUGGESTED | A TEMPORARY STOP IS SUGGESTED DUE TO HIGH LOAD - IF THE USER DOES NOT WISH TO STOP, THE PARAMETERS (PERIODS) ARE BOTH INCREASED (E.G., A: 7 SEC, B: 0.6 SEC)<br>C:EXAMPLE "SHALL WE CONTINUE, OR SHALL WE PAUSE FOR A WHILE?" ("IF YOU WISH TO PAUSE, PLEASE SAY START WHEN YOU ARE READY TO START AGAIN") |
| LOAD LEVEL4 | ++ | ++ | SPEECH SLIGHTLY SLOWED DOWN | A PAUSE IN SERVICE IS SUGGESTED | AS THE LOAD IS VERY HIGH, THE USER IS ENCOURAGED TO STOP USING THE SERVICE - IF THE USER CHOOSES NOT TO STOP, THE PARAMETERS (PERIODS) ARE BOTH INCREASED (E.G., A: 7 SEC, B: 0.7 SEC).<br>C:EXAMPLE "WE ADVISE THAT THE SERVICE BE STOPPED FOR NOW. DO YOU WISH TO STOP?" |
| LOAD LEVEL5 | ++ | ++ | SERVICE IS STOPPED | | THE SERVICE IS FORCIBLY STOPPED DUE TO A HIGH RISK SITUATION<br>PARAMETERS (PERIODS) ARE BOTH INCREASED (E.G., A: 7 SEC, B: 0.8 SEC).<br>C:"THE SERVICE IS PAUSED FOR NOW." |

+…THE TIME IS LENGTHENED

INFORMATION PROVIDING METHOD FOR VEHICLE AND INFORMATION PROVIDING APPARATUS FOR VEHICLE

BACKGROUND OF THE INVENTION

1. Field of the Invention

The present invention relates to an information providing method for vehicle and an information providing apparatus for vehicle to be adopted to provide information requested by an operator (user) aboard a vehicle to the vehicle.

2. Description of the Related Art

There is an information providing system known in the related art that includes an interactive voice response apparatus installed at an information center which provides various types of information to vehicles in response to requests issued from the user so as to recognize the types of information desired by the user without requiring any intervention of an operator at the information center (see Japanese Laid Open Patent Publication No. 2002-318132).

SUMMARY OF THE INVENTION

However, since the interactive voice response apparatus employed in the information providing system in the related art provides uniform audio guidance regardless of the specific condition under which a given driver is driving his vehicle, a problem arises in that the driver may not be able to hear the audio guidance or may not be able to respond to the audio guidance promptly under a high driving-load condition.

The present invention provides an information providing method for vehicle and an information providing apparatus for vehicle that make it possible to provide an interactive voice response service in a manner appropriate to the specific condition under which the driver is driving the vehicle.

In an information providing method for vehicle according to the present invention through which information to be provided to a user aboard a vehicle having an on-vehicle apparatus installed therein is determined through a dialogue between the user and an interactive voice response apparatus installed at an information center and information thus determined is transmitted to the on-vehicle apparatus, vehicle information indicating conditions of the vehicle is transmitted from the on-vehicle apparatus to the information center before audio guidance provided by the interactive voice response apparatus begins, the interactive voice response apparatus at the information center judges a driving load level indicating a level of driving load on a driver based upon the vehicle information and the manner with which interactive voice response is provided to the user is changed based upon the driving load level.

An information providing apparatus for vehicle according to the present invention includes a reception device that receives vehicle information indicating conditions of a vehicle, which is transmitted from an on-vehicle apparatus, a driving load judging device that judges a driving load level based upon the vehicle information received at the reception device, an information storage device in which a plurality of types of information to be provided to a user aboard the vehicle having the on-vehicle apparatus installed therein are stored, an interactive voice response device equipped with a speech recognition function, which conducts a dialogue with the user through interactive voice response via a telephone line, an information acquisition device that obtains specific information determined based upon the dialogue between the user and the interactive voice response device from the information storage device and an information transmission device that transmits the information obtained by the information acquisition device to the on-vehicle apparatus. The interactive voice response device changes the manner with which interactive voice response is provided to the user based upon the driving load level judged by the driving load judging device.

BRIEF DESCRIPTION OF THE DRAWINGS

FIG. 4 is an example of vehicle information transmitted from the on-vehicle apparatus;

FIGS. 5A–5*c* show a table used to determine the level of the driving load based upon the vehicle information;

FIG. 6 is a chart provided to facilitate an explanation of the response processing method adopted in the IVR system to execute the response processing in correspondence to varying driving load levels;

DETAILED DESCRIPTION OF THE PREFERRED EMBODIMENT

Figure 1:
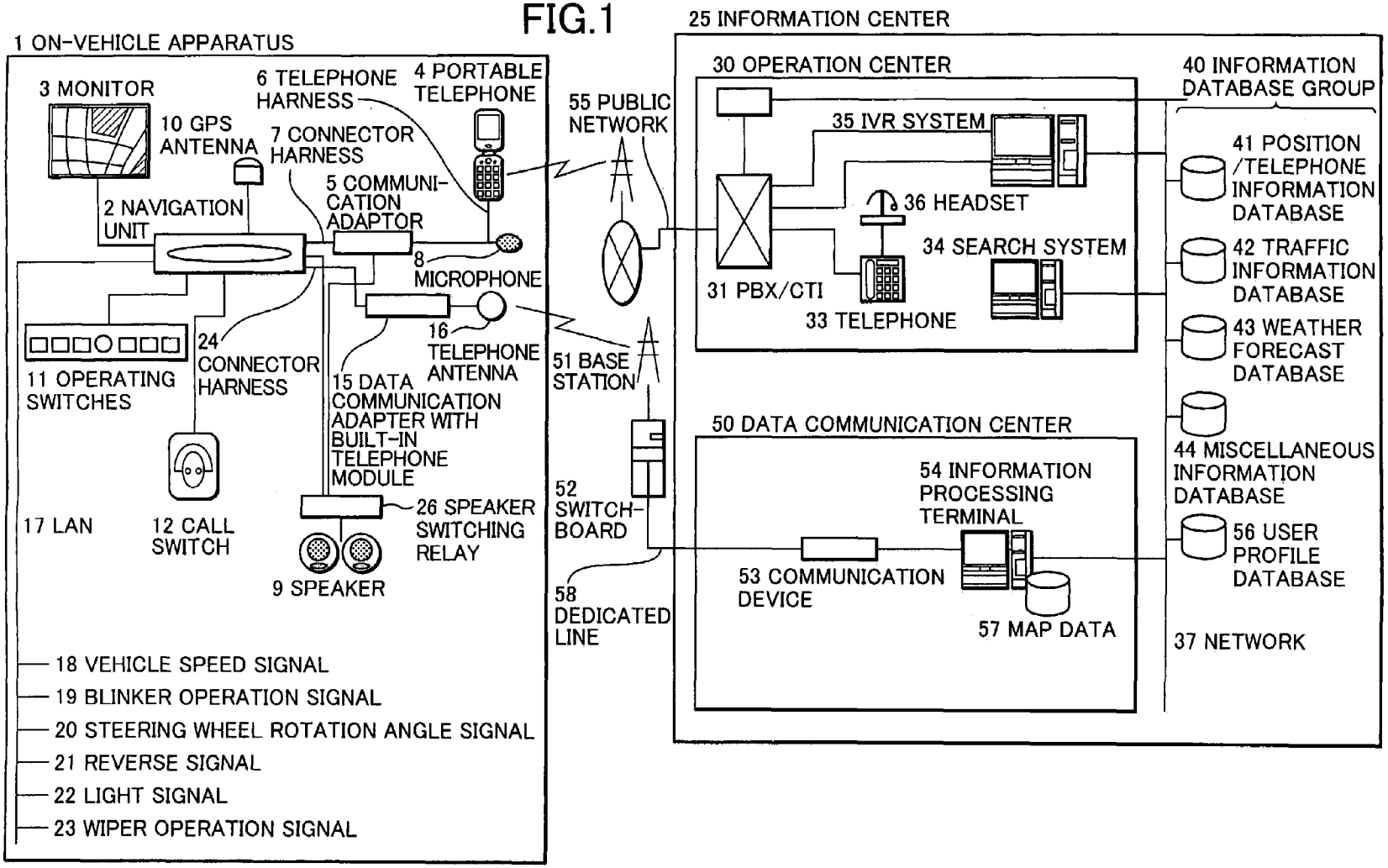
FIG. 1 shows the overall structure adopted in an embodiment of an information providing system for vehicle that includes the information providing apparatus for vehicle according to the present invention.

FIG. 1 shows the overall structure adopted in an embodiment of an information providing system for vehicle having the information providing apparatus for vehicle according to the present invention. A user of this information providing system for vehicle issues a request for desired information to an information center (information providing apparatus for vehicle) 25 via an on-vehicle apparatus 1 and downloads the information prepared by the information center 25 to the on-vehicle apparatus 1.

The on-vehicle apparatus 1 includes a navigation unit 2, a monitor 3, a communication adapter 5, a telephone harness 6 used to connect a portable telephone 4 to the communication adapter 5, a connector harness 7 used to connect the communication adapter 5 to the navigation unit 2, a microphone 8, a speaker 9, a GPS antenna 10, operating switches 11, an operator call switch 12, a data communication adapter 15 with a built-in telephone module (hereafter referred to as the data communication adapter 15), a telephone antenna 16, a connector harness 24 used to connect the data communication adapter 15 to the navigation unit 2 and a speaker switching relay 26.

The navigation unit 2, which includes a CPU, a ROM, a RAM and the like (not shown), is equipped with a function of searching for a route to be taken to reach a destination. At the monitor 3, the current position of the vehicle, the recommended route to the destination calculated at the navigation unit 2 and the like are displayed. In addition, information such as traffic information and weather forecast downloaded from the information center 25 can be displayed at the monitor 3, as well. The portable telephone 4 is used to request desired information by calling the information center 25 and to engage in data communication with the information center 25.

A vehicle speed signal 18, a blinker operation signal 19 indicating the operating state of the blinker, a steering wheel rotation angle signal 20 indicating the steering angle of the steering wheel, a reverse signal 21 indicating whether or not the vehicle is backing up, a light signal 22 indicating whether or not the headlamps are on and a wiper operation signal 23 indicating the operating state of the windshield wipers are all input to the navigation unit 2 via a vehicle internal LAN 17.

The microphone 8 is used by the user to communicate with the information center 25 to request a specific type of information by using a handsfree system. Through the speaker 9, route guidance provided by the navigation unit 2 and information downloaded from the information center 25 are output as audio messages. In addition, when the user talks to the information center 25 through the handsfree system, the speech transmitted from the information center 25 is output as audio messages through the speaker 9.

The speaker switching relay 26 switches the speaker 9 to output the route guidance provided by the navigation unit 2, a telephone conversation during a handsfree talk or sound generated at an audio device (not shown). The GPS antenna 10 receives radio waves from a GPS satellite (not shown) to obtain information indicating the current position of the vehicle.

The operating switches 11 are operated to perform various operations, e.g., to manipulate the screen displayed at the monitor 3, to use the handsfree system and to perform data communication. The operator call switch 12 is operated to originate calls to an operation center 30 and a data communication center 50 at the information center 25.

The communication adapter 5 is equipped with the handsfree function and implements control to enable a conversation and data communication with the information center 25 via the portable telephone 4. In addition, at the communication adapter 5, the telephone number of the operation center 30 at the information center 25, which is to be detailed later, is registered, and as the user presses the operator call switch 12, a call is automatically originated to connect with the operation center 30 (a call is originated). The telephone number of the operation center 30 maybe registered, for instance, before the communication adapter 5 is shipped from the factory.

The telephone number of the data communication center 50 at the information center 25, which is to be detailed later, is registered at the data communication adapter 15 having the built-in communication module and, as the user presses the operator call switch 12, a call is generated automatically to connect with the data communication center 50.

The information center 25 includes the operation center 30, an information data base group 40 and the data communication center 50. The operation center 30, the information database group 40 and the data communication center 50 are connected with one another via a network 37 such as a LAN. The operation center 30 includes a PBX/CTI 31 that controls telephone lines, a telephone 33, an information search system 34, an IVR (interactive voice response) system 35 and a headset 36.

A PBX (private branch exchange), which is normally installed in an office building or the like, functions as a switchboard to connect an outside telephone line with an extension line and to connect an extension line to another extension line. A CTI (computer technology integration) integrates a telephone communication system such as a PBX with an information system including a computer, a database and the like and allows the telephone communication system and the information system to interlock with each other. In other words, the PBX/CTI 31 implements telephone line control so as to connect a call made by a user to an operator, and to output on-hold audio guidance if all the operators are currently busy. It is to be noted that the PBX/CTI 31 is connected to a public telephone network 55.

Figure 2:
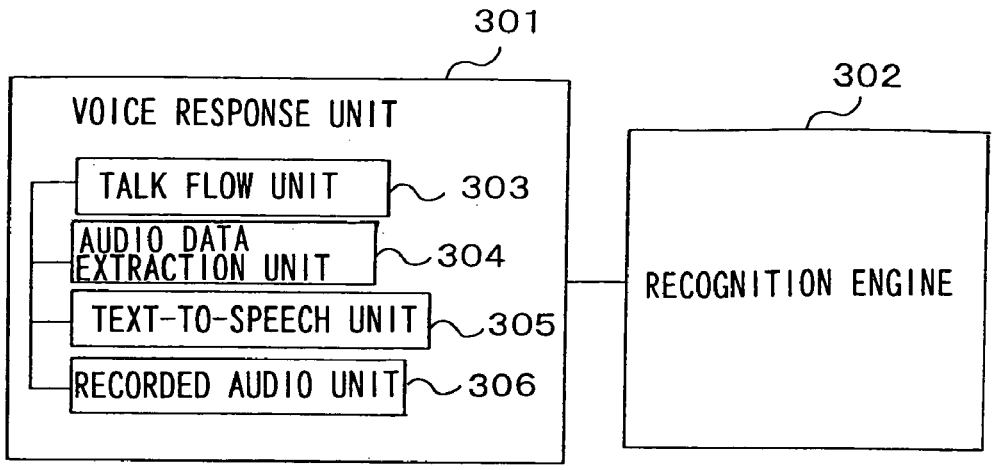
FIG. 2 shows in detail the structure adopted in the IVR system.

The IVR system 35 is a computer system capable of providing interactive voice response and is equipped with a speech recognition function and a speech synthesizing function. The structure of the IVR system 35 is shown in detail in FIG. 2. The IVR system 35 in the embodiment includes a voice response unit 301 and a recognition engine 302. The voice response unit 301 includes a talk flow unit 303, an audio data extraction unit 304, a text-to-speech unit 305 and a recorded audio unit 306.

The audio data extraction unit 304 extracts audio data corresponding to the speech made by the user (user response speech) from collected audio that contains the user speech and background noise, and transmits the extracted audio data to the recognition engine 302. The recognition engine 302 executes speech recognition processing on the audio data and transmits the results of the recognition processing to the voice response unit 301. The voice response unit 301 extracts talk data to be used to provide guidance for the user from the talk flow unit 303 based upon the results of the speech recognition processing executed by the recognition engine 302, converts the talk data to audio data via the text-to-speech unit 305 and provides guidance for the user. At this time, audio data stored in advance at the recorded audio unit 306 maybe output. It is to be noted that various types of speeches to be used to conduct a dialogue with the user are stored at the talk flow unit 303.

Figure 3:
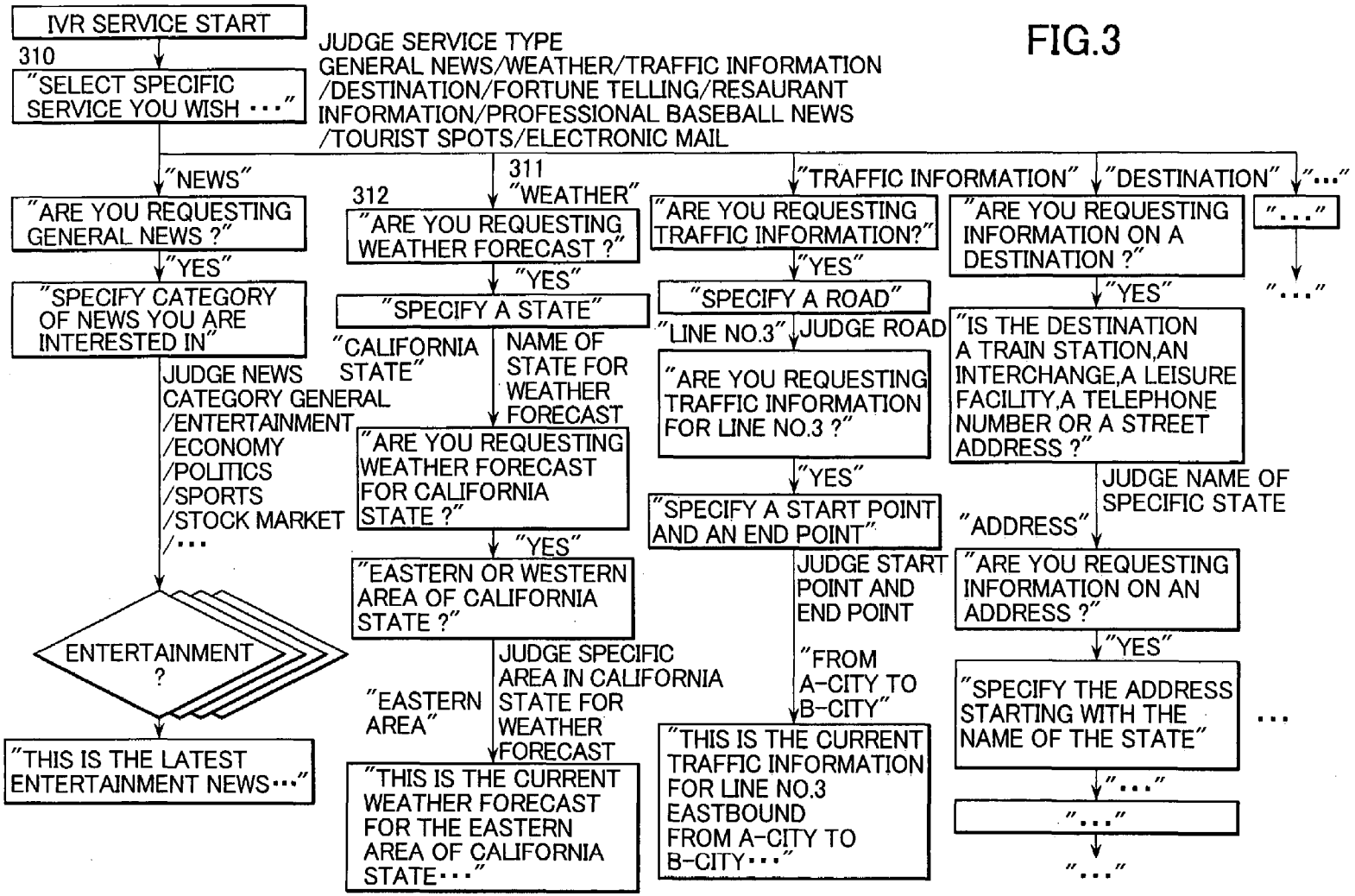
FIG. 3 presents an example of an interactive voice response service.

FIG. 3 presents an example of the flow of the interactive voice response service provided by the IVR system 35. As the interactive voice response service by the IVR system 35 starts, audio guidance is first provided in the form of, for instance, an audio message "Please select a specific service" to prompt the user to request a desired type of information.

If the user says "weather", for instance, the audio data of the speech made by the user are transmitted to the recognition engine 302 via the audio data extraction unit 304, and the recognition engine 302 executes the speech recognition processing. Based upon the results of the speech recognition processing, the voice response unit 301 extracts a speech ("Are you requesting weather information?") as a response to the user's speech, i.e. "weather", from the talk flow unit 303 and provides audio guidance to the user via the text-to-speech unit 305. Subsequently, audio guidance is provided to prompt the user to specify a region such as a state and an area (the eastern or western area of the state) and thus, the information to be provided to the user is determined as shown in FIG. 3.

Various types of information including general news, weather, traffic information, destination information related to a destination to be set at the navigation unit 2, fortune telling, restaurant information, sports information, tourist spot information and electronic mail can be provided to the user. Speeches to be used to provide appropriate audio guidance for the user are prepared in advance in correspondence to the individual types of information and are stored in the talk flow unit 303.

In the vehicle information providing system in the embodiment, the speed with which the audio guidance (talk) is output from the IVR system 35 and the like are adjusted in correspondence to the state of the vehicle (the driving load). This processing is to be detailed later.

The IVR system 35 is installed at the operation center 30 in the vehicle information providing system in the embodiment, and operators are on duty at the operation center 30. An operator talks to the user via the telephone 33 or the headset 36. In addition, the operator searches for the information desired by the user by using the information search system 34. The information search system 34 and the IVR system 35 are both connected with a plurality of databases 41 to 44 and 56 constituting the information database group 40 through the network 37 which may be a LAN.

The information database group 40 includes a position/telephone information database 41, a traffic information database 42, a weather forecast database 43, a miscellaneous information database 44 and a user profile database 56.

At the position/telephone information database 41, position information and telephone number information with regard to various types of facilities such as restaurants and public facilities are stored. Traffic information on standard roads and toll roads is stored in the traffic information database 42. Weather forecast information for various regions is stored at the weather forecast database 43. Information other than the information on the various types of facilities, the traffic information and the weather information described above is stored in the miscellaneous information database 44. User information indicating the name, the residential address, the portable telephone number, the user ID and the like of each pre-registered user is stored in the user profile database 56. The method of user registration is to be detailed later.

A communication device 53, an information processing terminal 54 and map data 57 are installed at the data communication center 50. The communication device 53 engages in data communication with the on-vehicle apparatus 1. The communication device 53 is connected with a base station 51 and a switchboard 52 of the communication business system via a dedicated line 58. The information processing terminal 54 processes data to be used in data communication with the on-vehicle apparatus 1.

As mentioned earlier, the IVR system 35 in the vehicle information providing system in the embodiment adjusts the speed with which the audio guidance is output from the IVR system 35 and the like in correspondence to the state of the vehicle (the driving load). Based upon vehicle information transmitted from the on-vehicle apparatus 1, the information processing terminal 54 at the data communication center 50 executes processing to judge the driving load. The vehicle information contains the vehicle speed signal 18, the blinker operation signal 19, the steering wheel rotation angle signal 20, the reverse signal 21, the light signal 22, the wiper operation signal 23 and the information indicating the current vehicle position. An example of the vehicle information transmitted from the on-vehicle apparatus 1 to the information processing terminal 54 at the data communication center 50 is presented in FIG. 4.

FIGS. 5A–5C show a table used to judge the level of the driving load on the driver (the driving load level) based upon the vehicle information. The driving load is judged to be at one of five levels, 1 to 5, and the driving load is considered to be heavier when the level is higher. In a field 60 in FIG. 5A, examples of vehicle positions that may affect the driving load are presented. More specifically, the driving load increases when the vehicle is traveling near an intersection, traveling through an alley, negotiating a curve, traveling on an express highway, driving through a toll booth or entering or exiting a parking lot. Sensing data obtained by sensing the vehicle information transmitted from the on-vehicle apparatus 1, i.e., the blinker operation signal, the steering wheel rotation angle signal, the wiper operation signal, the light signal and the reverse signal, are entered in a field 61 in FIG. 5B.

The various vehicle positions in the field 60 and the sensing data in the field 61 are weighted (graded) for purposes of the driving load judgment. An example of such weighting is shown in a field 62. In the example presented in FIG. 5A, varying points 5, 4, 3, 2, 3 and 4 are respectively awarded when the vehicle is at an intersection, an alley, a curve, an express highway, a toll booth and an entrance/exit of a parking lot. In addition, four points are awarded when the blinker is engaged, four points are awarded when the steering wheel rotation angle is equal to or greater than a predetermined angle (e.g., 30°), two points are awarded when the wipers are operating, one point is awarded when the lights are on and five points are awarded when the vehicle is moving backward. These varying numbers of points to be awarded under different circumstances are determined in advance by taking into consideration, for instance, that the driving load is bound to be high at an intersection since the driver needs to pay close attention to vehicles ahead and the oncoming traffic and that the driving load is bound to be high when the vehicle is backing up, since the driver needs to check for any rearward obstacles.

In a field 63 of the table shown FIG. 5B, the total of the points calculated based upon the vehicle information is indicated. For instance, the vehicle conditions in entry 7 are; the vehicle is at an intersection, the steering wheel rotation angle is equal to or greater than 30° and the wipers are operating, resulting in a total of 5+4+2=11 points. The driving load is judged to be at one of the five levels based upon the total points indicated in the field 63. In this example, the driving load levels 1, 2, 3, 4 and 5 respectively correspond to the total points of 1 to 4, 5 to 8, 9 to 12, 13 to 16, and 17 or over.

It is to be noted that the vehicle conditions deduced from the data in the fields 60 and 61 are indicated in a field 65 in FIG. 5C. While the deduced vehicle conditions in the field 65 are not used to calculate the driving load level indicated in the field 64, they are used as reference when correcting the driving load level. For instance, when the deduced vehicle conditions indicate heightened risk even though the driving load level is judged to be 2 in correspondence to a total of, for example, 7 points calculated based upon the data in the fields 60 and 61, the load level can be adjusted to 5 from 2 in reference to the deduced vehicle conditions.

FIG. 6 is a chart provided to facilitate an explanation of the response processing method adopted in the IVR system 35 to provide response in correspondence to a specific driving load level. The IVR system 35 in the embodiment adjusts the recognition parameters and the talk flow in correspondence to the driving load level. The recognition parameters include a recognition wait period and a recognition start lead time.

The term "recognition wait period" refers to the period of time during which the user's speech is recognized after the IVR system 35 provides audio guidance, i.e., the period of time during which the speech recognition processing is executed. If no speech by the user is recognized during this period, the IVR system 35 outputs the next speech (in a response prompt flow or the like). If the driving load is high, the recognition wait period is set to a greater value. For instance, the recognition wait period may be set to 7 seconds when the driving load level is 2 to 5, two seconds longer than the normal recognition wait period (5 sec).

The term "recognition start lead time" refers to the length of time elapsing before the speech recognition processing starts following the audio guidance by the IVR system 35, i.e., the length of time elapsing before the count of the recognition wait period described above starts. When the driving load is high, the user is likely to be unable to respond immediately to the audio guidance by the IVR system 35, and accordingly, the recognition start lead time is lengthened in order to remove noise or the like that might otherwise be collected before the user starts his speech. For instance, if the normal recognition start lead time is 0.3 sec, it may be adjusted to 0.3 sec, 0.5 sec, 0.6 sec, 0.7 sec or 0.8 sec respectively in correspondence to the driving load levels 1, 2, 3, 4 and 5.

The talk flow includes a flow through which the standard audio guidance is provided and the response prompt flow. When the driving load level is 1 to 4, the audio guidance by the IVR system 35 is output at a slightly slower speed compared to the standard speed. However, when the driving load level is 5, it is assumed that carrying on a conversation while driving is dangerous, and accordingly the audio guidance is forcibly terminated. In such a case, the user receives an audio message such as "The guidance ends for now". When the driving load level is 3, the user receives an audio message prompting a temporary stop to the conversation such as "Shall we continue or pause for a while?" When the driving load level is 4, the user receives an audio message prompting a cancellation of the conversation (service) such as "We advise that the service be temporarily paused. Do you wish to pause now?"

It is to be noted that as shown in FIG. 3, the IVR system 35 and the user exchange several verbal messages before the user completes the process of communicating the type of information he desires. During this dialogue, the vehicle information is transmitted from the on-vehicle apparatus 1 to the data communication center 50 on a regular basis and the driving load level is judged repeatedly. Thus, if the vehicle conditions (the driving load level) change while the dialogue between the IVR system 35 and the user is in progress, the audio guidance is provided in correspondence to the updated driving load level.

In order to utilize the vehicle information providing system in the embodiment, the user needs to pre-register himself as a user. He may register himself with the vehicle information providing system by mail, by entering general information such as the user name and the residential address together with the telephone number of the portable telephone 4 to be used in conjunction with the system into a specific sign-up form and mailing the form to the operation center 30 at the information center 25. After checking the contents of the sign-up form, the operator at the operation center 30 executes user registration processing by storing the user information into the user profile database 56. At this time, a user ID inherent to the specific user is issued to the user as detailed below. The user ID is also stored into the user profile database 56 in correspondence to user information such as the user name.

Upon completing the user registration processing at the user profile database 56, the user receives the user ID. When the user utilizes the information providing services offered by the information center 25, a user authentication is executed based upon the user ID. Namely, the user enters the user ID issued to him at the on-vehicle apparatus 1, and the user ID is transmitted to the information center 25 when a data communication is executed between the on-vehicle apparatus 1 and the information center 25. The information center 25 executes the user authentication based upon whether or not the user ID having been transmitted thereto matches a user ID stored in the user profile database 56.

Figure 7:
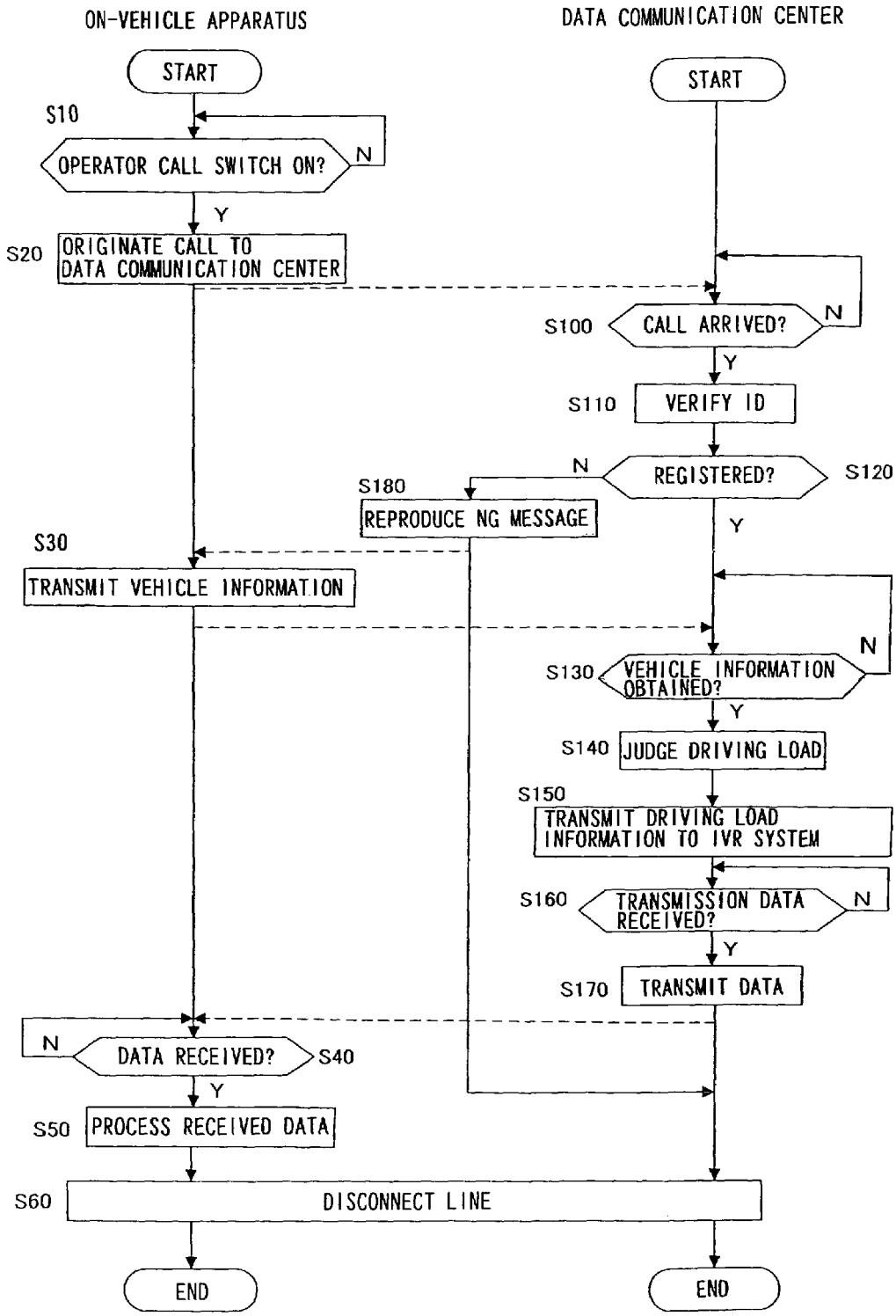
FIG. 7 presents a flowchart of the processing executed at the on-vehicle apparatus and the data communication center in an embodiment.
Figure 8:
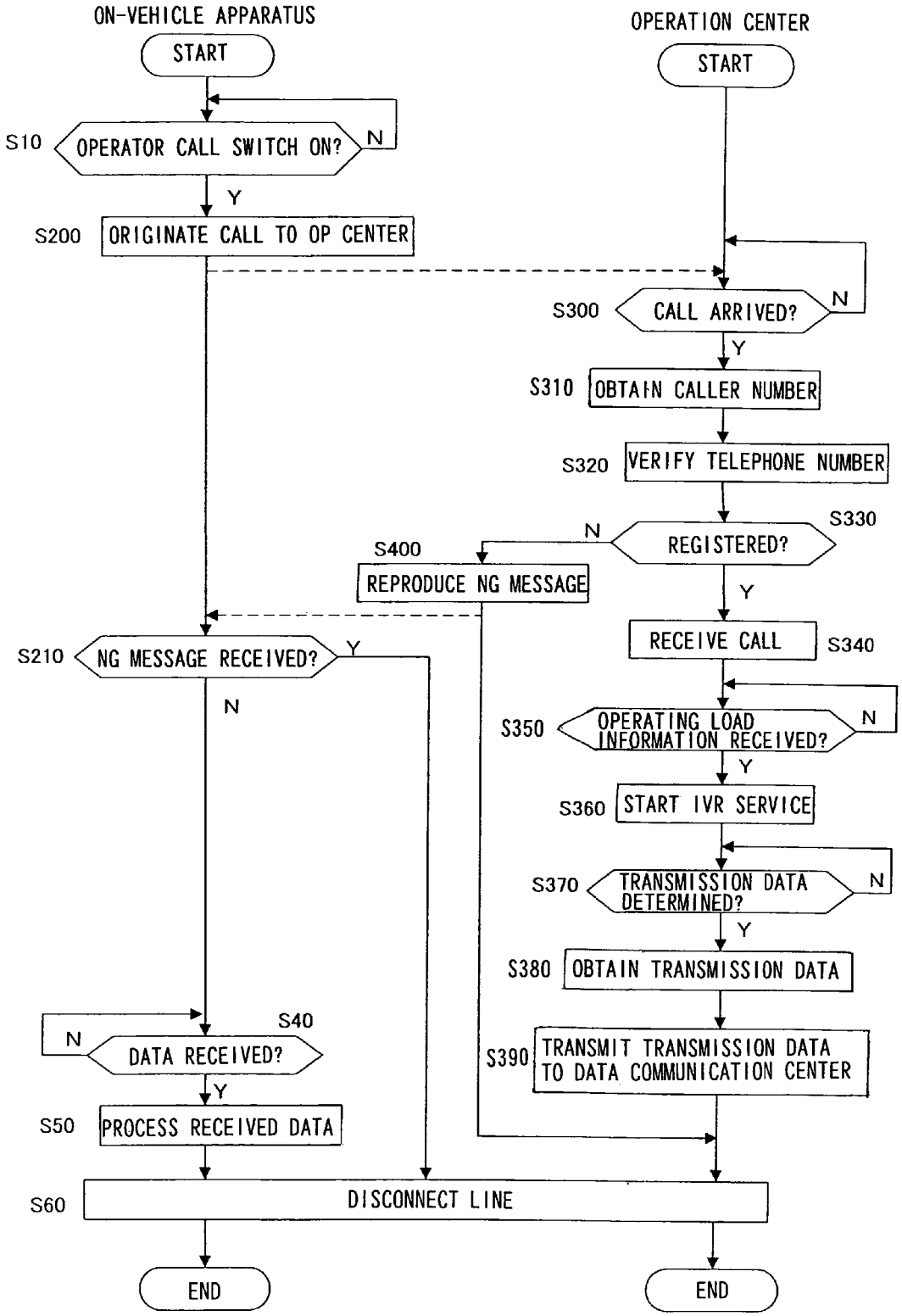
FIG. 8 presents a flowchart of the processing executed at the on-vehicle apparatus and the operation center.

The processing executed at the on-vehicle apparatus 1 and the processing executed at the information center 25 are now explained in reference to the flowcharts presented in FIGS. 7 and 8. FIG. 7 presents a flowchart of the details of the processing executed at the on-vehicle apparatus 1 and the processing executed at the data communication center 50 in the vehicle information providing system in the embodiment.

In step S10, the on-vehicle apparatus 1 makes a decision as to whether or not the operator call switch 12 has been turned on. If it is decided that the operator call switch 12 has not been turned on, the operation waits in standby in step S10 until the operator call switch 12 is turned on, and once it is decided that the operator call switch 12 has been turned on, the operation proceeds to step S20.

In step S20, a telephone call is originated to connect with the data communication center 50 via the data communication adapter 15 and the telephone antenna 16. As explained earlier, the telephone number of the data communication center 50 is pre-registered at the data communication adapter 15 and thus, the telephone connection with the data communication center 50 is automatically established as the user presses the operator call switch 12.

As the call is originated from the on-vehicle apparatus 1 to connect with the data communication center 50, the call arrives at the data communication center 50 via the base station 51, the switchboard 52 and the dedicated line 58. In step S100, the communication device 53 makes a decision as to whether or not a call from an on-vehicle apparatus 1 has arrived. If it is decided that no call has arrived, the operation waits in standby in step S100 until a call arrives, whereas if it is decided that a call has arrived, the operation proceeds to step S110.

In step S110, the user ID is verified. The user ID is transmitted from the on-vehicle apparatus 1 through data communication. Accordingly, the information processing terminal 54 references the user profile database 56 to ascertain whether or not the transmitted user ID is registered at the user profile database 56. Upon completing the user ID verification processing, the operation proceeds to step S120.

In step S120, a decision is made as to whether or not the user ID has been verified successfully through the user ID verification executed in step S110, i.e., whether or not the transmitted user ID has a match in the user profile database 56, and if an affirmative decision is made in step S120, the operation proceeds to step S130. If, on the other hand, the transmitted user ID does not have a match in the user profile database 56 and, accordingly, it is decided that the verification has been unsuccessful, the operation proceeds to step S180. In step S180, a message such as "Your ID is not registered. Unregistered users cannot receive the service" is transmitted to the on-vehicle apparatus 1 before the telephone line is disconnected.

In step S30, the on-vehicle apparatus 1 transmits the vehicle information indicating the vehicle conditions to the data communication center 50. The vehicle information includes the vehicle position information as well as the vehicle speed signal 18, the blinker operation signal 19, the steering wheel rotation angle signal 20, the reverse signal 21, the light signal 22 and the wiper operation signal 23 input to the navigation unit 2. Such vehicle information, which is normally used at the navigation unit 2 or at another unit (not shown) connected to the vehicle internal LAN 17, does not need to be specially prepared for this system. It is to be noted that the vehicle information is transmitted regularly, e.g., every 1 second.

In step S130, the information processing terminal 54 at the data communication center 50 makes a decision as to whether or not the vehicle information transmitted by the on-vehicle apparatus 1 in step S30 has been received. If it is decided that the vehicle information has been received, the operation proceeds to step S140, whereas if it is decided that the vehicle information has not been received, the operation waits in standby in step S130. In step S140, processing is executed to judge the driving load based upon the vehicle information received from the on-vehicle apparatus 1. Since the method that may be adopted to judge the driving load level based upon the vehicle information has been explained earlier, it is not explained in detail here. Upon completing the driving load judging processing, the operation proceeds to step S150.

In step S150, the driving load level determined in step S140 is transmitted to the IVR system 35 at the operation center 30 via the network 37. It is to be noted that as the vehicle information is transmitted from the on-vehicle apparatus 1 on a regular basis, the driving load judging processing in step S140 and the driving load level transmission processing in step S150 are repeatedly executed.

The IVR system 35 at the operation center 30 starts the interactive voice response service based upon the driving load level information transmitted from the information processing terminal 54 at the data communication center 50. The processing executed by the IVR system 35 at this time is to be explained in detail later in reference to the flowchart presented in FIG. 8. As the information to be transmitted to the user is determined through the dialogue with the user, the IVR system 35 transmits the transmission data thus determined to the information processing terminal 54.

In step S160 following step S150, the information processing terminal 54 makes a decision as to whether or not the data to be transmitted to the user have been received from the IVR system 35. The operation proceeds to step S170 if it is decided that the transmission data have been received, whereas the operation waits in standby in step S160 if it is decided that the transmission data have not yet been received. In step S170, the data received from the IVR system 35 are transmitted to the on-vehicle apparatus 1 that requested the information.

The on-vehicle apparatus 1 makes a decision in step S40 as to whether or not the data from the data communication center 50 have been received. The operation proceeds to step S50 if it is decided that the data have been received, whereas the operation waits in standby in step S40 if it is decided that the data have not been received. In step S50, the received data are processed. For instance, if the received data are current news or weather information, the received data are reproduced as an audio output through the speaker 9 and also the received data are displayed at the monitor 3. If the received data are destination setting information, the navigation unit 2 is engaged to execute destination setting processing. Once the received data are processed, the line connecting the on-vehicle apparatus 1 and the data communication center 50 is cut off in step S60.

Next, the processing executed by the IVR system 35 at the operation center 30 is explained in reference to the flowchart presented in FIG. 8. It is to be noted that the same step numbers are assigned to the steps of processing executed by the on-vehicle apparatus 1 that are identical to the processing having been explained in reference to the flowchart in FIG. 7.

In step S10, the on-vehicle apparatus 1 makes a decision as to whether or not the operator call switch 12 has been turned on. If it is decided that the operator call switch 12 has not been turned on, the operation waits in standby in step S10 until the operator call switch 12 is turned on, and once it is decided that the operator call switch 12 has been turned on, the operation proceeds to step S200.

In step S200, a telephone call is originated to connect with the operation center 30 via the communication adapter 5 and the portable telephone 4. As explained earlier, the telephone number of the operation center 30 is pre-registered at the communication adapter 5 and thus, the telephone connection with the operation center 30 is automatically established as the user presses the operator call switch 12. In other words, the on-vehicle apparatus 1 in the embodiment automatically originates calls to the operation center 30 and the data communications center 50 as the operator call switch 12 is turned on.

The call originated via the navigation unit 2, the communication adapter 5 and the portable telephone 4 in response to the ON operation of the operator call switch 12 arrives at the PBX/CTI 31 at the operation center 50 through the public network 55. The PBX/CTI 31 at the operation center 30 makes a decision in step S300 as to whether or not a call from an on-vehicle apparatus 1 has arrived. If it is decided that no call has arrived, the operation waits in standby in step S300 until a call arrives, whereas if it is decided that a call has arrived, the operation proceeds to step S310. In step S310, the PBX/CTI 31 obtains the call originator telephone number. At this time, if the call originator telephone number cannot be ascertained, the telephone line connecting the PBX/CTI 31 to the on-vehicle apparatus 1 may be cut off after reproducing a message such as "Undisclosed caller number". Upon obtaining the call originator telephone number, the operation proceeds to step S320.

The processing in steps S320 through S390 is executed by the IVR system 35. In step S320, the IVR system 35 executes a user authentication based upon the call originator telephone number obtained in step S310. Namely, a decision is made as to whether or not the call originator telephone number which has been obtained is stored in the user profile database 56.

In step S330 following step S320, a decision is made as to whether or not the call has been made by a registered user based upon the results of the user authentication processing executed in step S320. If it is decided that the call has originated from a registered user, i.e., the call originator telephone number is stored in the user profile database 56, the operation proceeds to step S340, whereas if it is decided that the caller is not a registered user, the operation proceeds to step S400. Instep S400, a message such as "Service cannot be provided to unregistered users" is transmitted to the on-vehicle apparatus 1 before the telephone line is disconnected.

In step S340, a telephone connection with the on-vehicle apparatus 1 is established (a call is received), before the operation proceeds to step S350. In step S350, a decision is made as to whether or not driving load information (indicating the driving load level) has been received from the information processing terminal 54 at the data communication center 50. This driving load level has been transmitted from the information processing terminal 54 to the IVR system 35 in step S150 in the flowchart presented in FIG. 7. The operation proceeds to step S360 if it is decided that the driving load level has been received, whereas the operation waits in standby in step S350 if it is decided that the driving load level has not been received.

In step S360, the interactive voice response service by the IVR system 35 starts. Since the method adopted to provide the interactive voice response service has been explained in reference to FIGS. 2 and 3, a detailed explanation is not given here. At this time, the recognition parameters and the talk flow are changed based upon the driving load level transmitted by the information processing terminal 54, as has been explained in reference to FIG. 6.

In step S370, a decision is made as to whether or not the data to be transmitted to the user have been determined through the interactive voice response service started in step S360. As explained earlier in reference to FIG. 3, the type of data to be transmitted to the user is determined through the audio guidance provided by the IVR system 35 and the user response to the audio guidance. If it is decided that the type of data to be transmitted to the user has not yet been determined, the interactive voice response service processing is continuously executed, whereas the operation proceeds to step S380 if it is decided that the data to, be transmitted have been determined.

In step S380, the IVR system 35 searches the information database group 40 via the network 37 to obtain the data to be transmitted to the user. Once the data to be transmitted to the user are obtained, the operation proceeds to step S390. In step S390, the data obtained in step S380 are transmitted to the information processing terminal 54 at the data communication center 50 via the network 37. Upon transmitting the data to the information processing terminal 54, the processing executed by the IVR system 35 ends.

Subsequently, the data are transmitted to the on-vehicle apparatus 1 from the information processing terminal 54 via the communication device 53, as has been explained in reference to steps S160 and S170 in the flowchart presented in FIG. 7. In step S40, the on-vehicle apparatus 1 makes a decision as to whether or not the data have been received, and if it is decided that the data have been received, the received data are processed in step S50. Once the received data are processed, the telephone line connecting the on-vehicle apparatus 1 to the operation center 30 is cut off.

As explained above, the information providing apparatus for vehicle in the embodiment is used in the information providing system for vehicle in which an operator (user) aboard the vehicle having the on-vehicle apparatus 1 installed therein calls the information center 25 to indicate the information he wishes to receive by following the audio guidance provided by the IVR system 35 installed at the information center 25 and the information center 25 prepares the information requested by the user and transmits the information to the on-vehicle apparatus 1. This information providing apparatus for vehicle judges the level of the driving load on the driver (the driving load level) based upon the vehicle information transmitted by the on-vehicle apparatus 1 and adjusts the manner with which the interactive voice response is provided to the user based upon the driving load level thus judged. As a result, the driver is able to indicate the desired information without further increasing the driving load under high driving-load conditions.

The manner with which the interactive voice response is provided is adjusted based upon the driving load level so that the automatic audio guidance provided to the user is slowed down as the driving load level increases. As a result, the driver can hear the audio guidance provided by the IVR system 35 with a higher degree of reliability even under high driving-load conditions. In addition, since the length of time elapsing before the speech recognition processing starts following the end of the automatic audio guidance is lengthened as the driving load level increases, the speech of the driver can be recognized with a high degree of reliability by removing noise that might be otherwise collected before the driver who is driving under a high driving load and cannot respond to the audio guidance immediately finally starts to talk. Furthermore, since the length of time over which the speech recognition processing is executed is increased as the driving load level becomes higher, the driver's speech can be recognized with a high degree of reliability even if the driver's speech becomes protracted.

The above described embodiments are examples, and various modifications can be made without departing from the spirit and scope of the invention. For instance, while calls are simultaneously originated to connect with the data communication center 50 via the data communication adapter 15 and to connect with the operation center 30 via the communication adapter 5 and the portable telephone 4 as the operator call switch 12 at the on-vehicle apparatus 1 is turned on in the explanation provided above, the calls do not need to be originated simultaneously. Namely, as long as a call is originated to connect with the data communication center 50 to ensure that the driving load level is transmitted from the information processing terminal 54 at the data communication center 50 to the IVR system 35 before the IVR system 35 is engaged in the interactive voice response, the call to the operation center 30 may be originated after calling the data communication center 50.

While the user authentication is executed in step S110 in the flowchart presented in FIG. 7 based upon the user ID issued when the user signs up in advance as a registered user, the user authentication may be executed instead based upon an ID (an on-vehicle apparatus ID) inherent to the on-vehicle apparatus 1. The on-vehicle apparatus ID maybe, for instance, a serial ID written when the on-vehicle apparatus 1 is shipped from the factory, which may be entered by the user in the signup form at the time of user registration. In addition, while the user authentication is executed based upon the telephone number of the portable telephone 4 in step S320 in the flowchart presented in FIG. 8, the user authentication may be executed by adopting another method.

While the information providing apparatus for vehicle in the embodiment executes the driving load judging processing at the information processing terminal 54 at the data communication center 50 and transmits the driving load level judged through the processing to the IVR system 35 at the operation center 30, the driving load level may instead be determined by the IVR system 35.

In addition, while the driving load level is judged based upon the vehicle position information, the blinker operation signal, the steering wheel rotation angle signal, the wiper operation signal, the light signal and the reverse signal, as shown in FIG. 5B, the driving load level may instead be determined based upon other types of information. Furthermore, the vehicle positions at which the driving load is assumed to be high are not limited to the examples given above, i.e., an intersection, an alley, a curve, an express highway, a toll booth and an entrance/exit of a parking lot.

Moreover, while the information prepared at the information center 25 is first transmitted from the operation center 30 to the data communication center 50 and is then transmitted to the on-vehicle apparatus 1 from the data communication center 50, the information may instead be provided as an audio output through the IVR system 35. In such a case, the information may be provided as an audio output through the text-to-speech unit 305 or the recorded audio unit 306 at the IVR system 35.

The disclosure of the following priority application is herein incorporated by reference: Japanese Patent Application No. 2003-147871, filed May 26, 2003.

What is claimed is:

1. An information providing method for vehicle through which information to be provided to a user aboard a vehicle having an on-vehicle apparatus installed therein is determined through a dialogue between the user and an interactive voice response apparatus installed at an information center and information thus determined is transmitted to the on-vehicle apparatus, comprising:

transmitting vehicle information indicating conditions of the vehicle from the on-vehicle apparatus to the information center before audio guidance provided by the interactive voice response apparatus begins;

judging a driving load level indicating a level of driving load on a driver based upon the vehicle information having been received; and changing the manner with which interactive voice response is provided to the user based upon the driving load level having been determined.

2. An information providing apparatus for vehicle comprising:

a reception device that receives vehicle information indicating conditions of a vehicle, which is transmitted from an on-vehicle apparatus;

a driving load judging device that judges a driving load level indicating a level of driving load on a driver based upon the vehicle information received at the reception device;

an information storage device in which a plurality of types of information to be provided to a user aboard the vehicle having the on-vehicle apparatus installed therein are stored;

an interactive voice response device equipped with a speech recognition function, which conducts a dialogue with the user through interactive voice response via a telephone line;

an information acquisition device that obtains specific information determined based upon the dialogue between the user and the interactive voice response device from the information storage device; and an information transmission device that transmits the information obtained by the information acquisition device to the on-vehicle apparatus, wherein:

the interactive voice response device changes the manner with which interactive voice response is provided to the user based upon the driving load level judged by the driving load judging device.

3. An information providing apparatus for vehicle according to claim 2, wherein:

the interactive voice response device lowers an audio output speed with which automatic audio guidance for the user is output as the driving load level becomes higher.

4. An information providing apparatus for vehicle according to claim 2, wherein:

the interactive voice response device increases a length of time to elapse before speech recognition processing starts following an end of automatic audio guidance provided for the user as the driving load level becomes higher.

5. An information providing apparatus for vehicle according to claim 2, wherein:

the interactive voice response device increases a length of time over which speech recognition processing is executed as the driving load level becomes higher.

6. An information providing apparatus for vehicle according to claim 2, wherein:

the vehicle information includes at least one of; vehicle position information, vehicle speed information, blinker operation information, wiper operation information, steering wheel rotation angle information, reverse information indicating that the vehicle is moving backward and light information indicating whether or not lamps are on.

7. An information providing apparatus for vehicle according to claim 6, wherein:

points are allocated to individual types of information included in the vehicle information to determine the driving load level; and the driving load judging device judges the driving load level based upon a total of points corresponding to individual types of information included in the vehicle information transmitted from the on-vehicle apparatus.

8. An information providing apparatus for vehicle comprising:

a reception means for receiving vehicle information indicating conditions of a vehicle, which is transmitted from an on-vehicle apparatus;

a driving load judgment means for judging a driving load level indicating a level of driving load on a driver based upon the vehicle information received at the reception means;

an information storage means for storing a plurality of types of information to be provided to a user aboard the vehicle having the on-vehicle apparatus installed therein;

an interactive voice response means, equipped with a speech recognition function, for conducting a dialogue with the user through interactive voice response via a telephone line;

an information acquisition means for obtaining specific information determined based upon the dialogue between the user and the interactive voice response means from the information storage means; and an information transmission means for transmitting the information obtained by the information acquisition means to the on-vehicle apparatus, wherein:

the interactive voice response means for changing the manner with which interactive voice response is provided to the user based upon the driving load level judged by the driving load judgment means.

* * * * *